US006860981B2

(12) United States Patent
Schetty, III et al.

(10) Patent No.: US 6,860,981 B2
(45) Date of Patent: Mar. 1, 2005

(54) MINIMIZING WHISKER GROWTH IN TIN ELECTRODEPOSITS

(75) Inventors: Robert A. Schetty, III, Ft. Salonga, NY (US); Winnie Ruth Vickers, Lynbrook, NY (US)

(73) Assignee: Technic, Inc., Plainview, NY (US)

( * ) Notice: Subject to any disclaimer, the term of this patent is extended or adjusted under 35 U.S.C. 154(b) by 0 days.

(21) Appl. No.: 10/136,858

(22) Filed: Apr. 30, 2002

(65) Prior Publication Data

US 2003/0201188 A1 Oct. 30, 2003

(51) Int. Cl.[7] ..... C25D 3/30; C25D 3/32; C23C 16/00

(52) U.S. Cl. ..... 205/300; 205/302; 106/1.25

(58) Field of Search ..... 427/430.1, 435, 427/436, 437; 205/300, 302; 106/1.25

(56) References Cited

U.S. PATENT DOCUMENTS

| | | | | | |
|---|---|---|---|---|---|
| 4,027,055 | A | * | 5/1977 | Schneble, Jr. | 427/98 |
| 2002/0104763 | A1 | * | 8/2002 | Yanada et al. | 205/241 |
| 2002/0187364 | A1 | * | 12/2002 | Heber et al. | 428/648 |
| 2003/0025182 | A1 | | 2/2003 | Abys et al. | 257/666 |

OTHER PUBLICATIONS

R. Schetty, "Whisker Growth Studies", Proceedings of IPC Annual Meeting, Session V, Paper B, Oct. 2001, Orlando, FL, USA.

R. Schetty, "Tin Whisker Growth and the Metallurgical Properties of Electrodeposited Tin", Proceedings of IPC/JEDEC meeting, pp. 137–161, May 2002, San Jose, CA USA.

R. Schetty, "Tin Whisker Studies—Experimentation & Mechanistic Understanding", Proceedings of AESF SUR/FIN Conference, Jun. 2002, Chicago, IL, USA.

R. Schetty, K. Hwang, Y. Zhang, "Whisker Growth—the Substrate Effect and Beyond", Proceedings of IEEE/CALCE Conference, Jan. 2003, Shenzen, China.

A. Egli, et al, "Where Crystal Planes Meet—Contribution to the Understanding of the Tin Whisker Growth Process", Proceedings of IPC Annual Meeting, Nov. 2002, New Orleans, LA, USA.

Lee, J, et al, "Whisker Formation Study of Lead–Free Plated Packages", Proceedings of IPC/JEDEC Pb–free Conference, Taipei, Taiwan, Dec. 2002.

W. J. Choi, T. Y. Lee, K. N. Tu, N. Tamura, R. S. Celestre, A. A. MacDowell, Y. Y. Bong, L. Nguyen, and G. T. T. Sheng, "Structure and Kinetics of Sn Whisker Growth on Pb–free Solder Finish", 52nd Electronic Component & Technology Conference Proceedings (IEEE Catalog No. 02CH3734–5), San Diego, CA, 628–633 (2002), no month.

* cited by examiner

*Primary Examiner*—Edna Wong
(74) *Attorney, Agent, or Firm*—Winston & Strawn LLP

(57) ABSTRACT

The present invention relates to a method for reducing tin whisker formation in tin deposits by plating on an underlying metal tin deposits which are predominantly in a predetermined crystal orientation that essentially matches that of the underlying metal in order to inhibit tin whisker growth. The most preferred crystal orientation is one that is the same as that of the underlying metal. The deposit preferably contains at least 95% tin and optionally at least one alloying element of silver, bismuth, copper or zinc in an amount of 5% or less. Advantageously, the tin deposits are provided during electroplating from a specially formulated plating solution.

30 Claims, No Drawings

MINIMIZING WHISKER GROWTH IN TIN ELECTRODEPOSITS

BACKGROUND

The present invention relates to a method and plating solution for depositing tin in a manner to reduce, minimize or prevent tin whisker growth from such deposits.

The use of a tin or tin alloy deposit has become increasingly important in fabricating electronic circuits, electronic devices and electrical connectors because of the benefits that such deposits provide. For example, tin and tin alloy deposits protect the components from corrosion, provide a chemically stable surface for soldering and maintain good surface electrical contact. There are many patents that disclose how to apply tin or tin alloy deposits using a variety of plating solutions and methods. Such deposits are typically produced by electroless plating or electroplating.

Regardless of the deposition process employed, it is desirable to form smooth and level deposits of tin on the substrate in order to minimize porosity. It is also desirable to form a coating having a relatively constant thickness in order to minimize etching problems. Furthermore, other problems must be avoided in order to obtain an acceptable deposit. When pure tin is used and is applied to a copper or copper alloy substrate, the resulting deposit suffers from interdiffusion and formation of copper-tin compounds. While these copper-tin compounds can be brittle and may impair the usefulness of the tin coated component, their presence also adversely affect subsequent soldering operations due to the generation of metal filaments known as tin whiskers which sometimes grow spontaneously from these tin deposits. These whiskers are hair-like projections extending from the surface and may be either straight or curled or bent. The presence of such whiskers is undesirable due to the very fine line definition required for modem circuitry, since these whiskers can form both electrical shorts and electrical bridges across insulation spaces between conductors.

The mechanics of the tin whisker problem are not clearly understood. The filaments can begin to grow within days of the application of the coating or even several years thereafter. There is speculation in the literature that the whiskers grow from stress concentration sites, such as those created in many electrodeposition techniques, as tin extrusions which are dendritic in nature. There is also speculation that temperature and humidity affect whisker growth. The article "Simultaneous Growth of Whiskers on Tin Coatings: 20 Years of Observation," by S. C. Britton, Transactions of the Institute of Metal Finishing, Volume 52, 1974, pp. 95–102 discusses the tin whisker growth problem and offers several recommendations for reducing the risk of whisker formation.

One approach for handling the tin whisker problem has been to specify short storage times for tin coated materials. However, this approach does not fully address or necessarily avoid the problem. Another approach has been to mildly strengthen the tin matrix to prevent extrusion of the whiskers. The formation of an intermetallic compound and diffusion of solute copper into the tin plate have served this purpose but at prohibitive performance cost in the final product.

Another approach is to treat the surface of the substrate before applying the tin deposit. Ultrasonic agitation of the plating solution and/or alternating the polarity of the electrodes during plating have been suggested to reduce the amount of hydrogen absorbed or occluded in the structure of the plating metal. Alternatively, one or more barrier layers or metals such as palladium, gold, silver, nickel, and/or copper can be used to prevent metal ion migration from the substrate into the tin deposit, thus reducing the stress on the deposit. These processes are undesirable due to the additional process steps required as well as due to the high cost of precious metals when they are used. Furthermore, the plating solutions for the barrier layer can sometimes contaminate or otherwise cause interference with the tin plating process.

Recent publications have indicated that tin deposited from methane sulfonic acid (MSA) solutions over copper/copper alloy substrates in the as-plated condition generally start out with no or slightly low compressive stress but during deposit aging compressive stress increases significantly. It is theorized that this increase in compressive stress is due to the formation of copper-tin intermetallic compounds, due to diffusion of copper from the base material into the tin deposit, and that this compressive stress generates tin whisker formation.

Additional approaches for dealing with this problem have generally involved a whisker inhibiting addition to the tin coating solution. A number of different tin-alloying metals including antimony, cobalt, copper, germanium, gold, lead and nickel have been suggested to reduce the growth of tin whiskers in the resulting deposit. In order to avoid the high cost of precious metals, the most common approach has been to deposit an alloy of tin and lead. This alloy is also compatible with the solders that are later used to make electrical connections to wires or other electrical components. Unfortunately, lead and a number of other alloying elements are undesirable due to their toxicity and related environmental issues.

Thus, an effective solution to the tin whisker problem still remains, and one is provided herewith.

SUMMARY OF THE INVENTION

The present invention relates to a method for reducing tin whisker formation in tin deposits by plating on an underlying metal tin deposits which are predominantly in a predetermined crystal orientation that essentially matches that of the underlying metal in order to inhibit tin whisker growth. The underlying metal can either be a substrate or a metal deposited on a substrate. A common metal is copper or a copper alloy and, in this case, the most preferred crystal orientation of the tin deposit is <220>. Also, the deposit preferably contains at least 95% tin and optionally at least one alloying element of silver, bismuth, copper or zinc in an amount of 5% or less. Advantageously, the tin deposits are provided during electroplating from a plating solution.

The invention also relates to a plating solution that includes an acid, a tin salt, and a crystal orienting surfactant. The acid is preferably a sulfonic acid, sulfuric acid, a halide ion acid, a fluoborate or mixtures thereof. The solution can also include an alkylol sulfonic acid or solution soluble salt thereof in an amount sufficient to improve deposit appearance. The crystal orienting surfactant preferably comprises a solution soluble organic compound having 2 to 4 joined rings, a total of 6 to 24 ring members, and at least one oxygen or nitrogen atom present in or attached to at least one of the rings. More preferably, the solution soluble organic compound has 2 to 3 fused rings, a total of 6 to 14 ring members, and at least one nitrogen atom present in each of at least two rings. Alternatively, the solution soluble organic compound is a condensation compound of an alkylene oxide or block copolymer. The most preferred surfactants are biquinolines, dialkyl phenanthrolines, block copolymers, or ethoxylated naphthols.

Another embodiment of the invention relates to a method for reducing tin whisker formation in plated tin deposits, which comprises plating tin or tin alloy deposits onto an underlying metal from one of the solutions disclosed herein so that the deposits are predominantly provided in a predetermined crystal orientation that essentially matches that of the underlying metal in order to inhibit tin whisker growth.

Yet another embodiment of the invention relates to a method of manufacturing an electronic component which comprises plating tin or tin alloy deposits from one of the solutions disclosed herein onto metallic portions of the electrical component so that the deposits are predominantly provided in a predetermined crystal orientation that essentially matches that of the underlying metallic portion in order to inhibit tin whisker growth.

And yet another embodiment of the invention relates to a method of reducing environmental contamination resulting from plated components which comprises plating components with a tin or tin alloy deposit from one of the solutions disclosed herein so that the deposits are predominantly provided in a predetermined crystal orientation that essentially matches that of the underlying component in order to inhibit tin whisker growth, thus avoiding the need to plate the components with a tin alloy that contains an environmentally harmful alloying element.

DETAILED DESCRIPTION OF THE PREFERRED EMBODIMENTS

A wide variety of basis solutions can be used to form the plating solutions of the present invention. These include the following:

FLUOBORATE SOLUTIONS: Tin fluoborate plating baths are widely used for plating all types of metal substrates including both copper and iron. See for example, U.S. Pat. Nos. 5,431,805; 4,029,556 and 3,770,599. These baths are preferred where plating speed is important and the fluoborate salts are very soluble.

HALIDE SOLUTIONS: Tin plating baths with the main electrolyte being a halide ion (Br, Cl, F, I) have been used for many decades. See for example, U.S. Pat. Nos. 5,628,893 and 5,538,617. The primary halide ions in these baths have been chloride and fluoride.

SULFATE SOLUTIONS: Tin and tin alloys are commercially plated from solutions with sulfate as the primary anion. See for example U.S. Pat. Nos. 4,347,107; 4,331,518 and 3,616,306. For example the steel industry has been tin plating steel for many years from sulfuric acid/tin sulfate baths where phenol sulfonic acid is used as a special electrolyte additive which improves both the oxidative stability of the tin as well as increasing its current density range. This process, known as the ferrostan process, is usable in the present invention but is not preferred because of environmental problems with phenol derivatives. Other sulfate baths based on sulfuric acid but without environmentally undesirable additives are preferred.

SULFONIC ACID SOLUTIONS: In the last decade the commercial use of sulfonic acid metal plating baths has increased considerably because of a number of performance advantages. Tin has been electroplated from sulfonic acid (See for example U.S. Pat. Nos. 6,132,348, 5, 4,701,244 and 4,459,185. The cost of the alkyl sulfonic acid is relatively high, so that the preferred sulfonic acid used has been methane sulfonic acid (MSA) although the prior art includes examples of other alkyl and alkanol sulfonic acids. The performance advantages of alkyl sulfonic acid baths include low corrosivity, high solubility of salts, good conductivity, good oxidative stability of tin salts and complete biodegradability.

These solutions can be used alone or in various mixtures. One of ordinary skill in the art can best select the most preferred acid or acid mixture for any particular plating application.

Alkali metal, alkaline earth metal, ammonium and substituted ammonium salts of one to five carbon alkyl and alkanol sulfonic acids have been found to improve the performance of these plating solutions. Especially preferred are salts of 2-hydroxy ethyl sulfonic acid, and particularly the sodium salt (sodium isethionate or "ISE"). These salts generally increase the plating range so that the solutions can be used at much higher current densities. The solutions can also be run at greater speeds. Further improvements are seen in the quality of the deposits, as well as in the oxidative stability of the tin.

The amount of tin (as tin metal) in the plating solutions of the present invention may be varied over a wide range such as from about 1 to about 120 grams of metal per liter of solution (g/l), or up to the solubility limit of the particular tin salt in the particular solution. In one embodiment, the tin is present in the range from about 5 g/l to about 80 g/l. In another embodiment, the tin is present in the range from about 10 g/l to about 50 g/l. In another embodiment, the tin is present in an amount from about 20 g/l to about 40 g/l. In another embodiment, the tin is present in an amount of about 30 g/l. In another embodiment, the tin is present in an amount of about 20 g/l. Higher levels of tin may be included in the plating solutions, but economics suggest, and solubility may dictate, that the metal levels be maintained at lower levels. It should be understood that the foregoing quantities of tin in the plating solution are disclosed as metallic tin, but that the tin may be added to the solutions in the form of tin compounds. Such compounds may include, for example, tin oxide, tin salts, or other soluble tin compounds, including formates, acetates, hydrochlorides and other halides, carbonates and the like.

Any one of a number of alloying elements can be added to the solution. These are primarily added in an amount such that less than 5% of the alloying element is present in the deposit. Preferred alloying elements include silver (up to 3.5% of the deposit), Bismuth (up to 3% of the deposit), copper (up to 0.7% of the deposit) and zinc (up to 2% of the deposit). While other alloying elements can be used, it is generally not preferred to use those that may have an adverse effect on the environment, i.e., antimony, cadmium, and particularly lead.

A wide variety of specific crystal orientation surfactants may be used in the present invention. One suitable surfactant is an alkylene oxide condensation compound of an aromatic organic compound or solution soluble derivatives thereof, wherein the compound has 2 to 4 joined rings, a total of 6 to 24 ring members, and at least one oxygen or nitrogen atom present in or attached to at least one of the rings. This aromatic compound may preferably contain two or three fused rings, preferably containing between 10 and 12 carbon atoms and 2 to 4 oxygen or nitrogen atoms. Also, the aromatic organic compound may include an alkyl moiety of six carbon atoms or less, and one or more hydroxyl groups. Preferably, the aromatic organic compound includes rings of benzene, naphthalene, phenol, quinoline, toluene, bisphenol A, styrenated phenol, or an alkylated derivatives thereof. Other surfactants, such as those based on block copolymers having a molecular weight between about 1000 and 4000, can instead be used.

The surfactant(s) to be added to the plating bath in accordance with the invention will not only improve the dispersibility of the components in the solution but will also ensure excellently adhesive, dense and smooth deposits. Especially, it has also been found that a cationic surfactant is markedly effective in preventing the dendrite growth in the high current region, whereas a nonionic surfactant improves the throwing power of the plating solution in the low current region. Preferred nonionic surfactants are selected from condensation products of ethylene oxide and/or propylene oxide with aryl ethers, alkyl ethers, quinolines, phenanthrolines, alkyl quinolines, alkyl phenanthrolines, phenols, styrenated phenols, alkyl phenols, naphthols, and alkyl naphthols. A combination of surfactants can be used depending on the current conditions to be adopted. For example, the combined use of the two different surfactants makes possible plating under a wide range of current conditions, rendering the invention applicable to all plating techniques, including the barrel, rack, through-hole, and high-speed continuous plating methods.

The alkylene oxide compound may be ethylene oxide wherein between about four and 40 moles of ethylene oxide, and preferably between six and twenty-eight, are used to form the condensation compound. Some of the moles of ethylene oxide, i.e., up to 50%, may be replaced with propylene oxide. One skilled in the art can easily determine the preferred amount of propylene oxide by routine testing.

The most preferred surfactants for use in combination with a sulfuric acid solution that also contains ISE in order to provide the preferred crystal orientation which hinders tin whisker growth are as follows:

2,2'-biquinoline—a heterocyclic compound 2,9-dimethyl-1,10 phenanthroline—a heterocyclic compound Jeffox WL1400—a EO/PO copolymer having a molecular weight of 1400

Noigen EN—a polyoxyethylene aryl ether, or more generic ethoxylated aromatic ether Ethoxylated beta-naphthol with 15 moles EO As noted above, compressive stress in tin deposits due to the formation of intermetallic compounds appears to generate tin whisker formation. In general, pure tin or tin alloys that contain small amounts of alloying elements generally exhibit a <211> crystal orientation when deposited upon a substrate from an MSA solution that contains conventional additives. As is known to one of ordinary skill in the art, the <211> designation is that of a crystal plane with the numbers referring to Miller indices. This particular orientation has been found to be one that is subject to high stress and from which whisker growth is facilitated. For that reason, this crystal orientation is not desirable. In contrast, tin deposits produced from mixed acid/non-MSA electrolytes combined with the specific additives of the invention do not show an increase in compressive stress over time. The results shown in Table I below were obtained for a 10 micron thick pure tin deposit over a brass substrate. Further insight into the mechanistic behavior of this system can be found by examining the preferred crystal orientation of the deposits over copper alloy substrate by X-ray-diffraction (XRD) below:

XRD Comparison

| Deposit Type | Preferred crystal orientation |
|---|---|
| MSA Tin | <211> |
| Mixed Acid/Non-MSA Tin | <220> |
| Tin-lead 60-40 | <220>, <200> |
| Tin-silver 97-3 | <220> |
| Reflowed Tin | <220>, <321> |

As these results indicate, tin deposits produced from the MSA electrolyte and the non-MSA electrolyte possess radically different preferred crystal orientations that essentially matches that of the underlying substrate, i.e., <211> vs. <220> respectively, which may help to explain their fundamentally different tin whisker growth behavior. The tin deposits from the mixed acid/non-MSA process with specific additives have a consistent <220> preferred crystal orientation which it shares in common with known base metals such as copper or a copper alloy (e.g. brass) as well as other known "non-whiskering" deposits such as tin-lead, tin-silver, and reflowed tin.

Additional investigations show that the preferred crystal orientation of the most commonly used copper alloy substrates in the electronics industry also have a preferred crystal orientation of <220>. Thus, this orientation is preferred when minimization of tin whiskering is desired for tin deposits that are plated on copper or copper alloy substrates.

In the present specification, the term "essentially the same" or "essentially matches" is used to include the crystal orientation of a deposit that is sufficiently close to that of the underlying substrate such that the degree of wiskering, if any, is less than that which would adversely affect the performance of the electroplated components. The most preferred orientations are those which are identical to that of the underlying metal. However, this is not always possible to achieve and improved performance can be obtained by providing crystal orientations that are as close as possible to the orientation of the underlying metal.

In support of this finding, it is noted that the following prior art reference sources teach that tin whiskers grow from grains whose crystal orientation is different from the major orientation of the underlying grains:

W C Ellis, et al, "*Growth and Perfection of Crystals*", Wiley & Sons, NY, N.Y. 1958, p. 102

B D Dunn, European Space Research & Technology Centre, ESA STR-223, September 1987

By correlation, the converse is expected to hold true, i.e., tin whiskers do not grow from grains whose crystal orientation is essentially the same as or preferably is identical to the major orientation of the underlying grains. Thus, by proper orientation of the crystal structure, tin whisker growth and formation can be minimized, reduced or even eliminated.

The invention minimizes or reduces tin wisker growth or formation by matching the crystal orientation of the tin deposit to that of the underlying metal. As one of ordinary skill in the art would recognize, the underlying metal can be a base metal substrate or a metal deposit that is plated or otherwise provided upon the substrate. The important consideration of the invention is to match as close as possible the crystal orientation of the tin deposit to that of the underlying metal that it contacts. Where multiple metal deposits are made upon a substrate, the crystal orientation of the upper most layer is that which should be considered. For example, in chip capacitors, a nickel deposit is routinely provided prior to tin, and the tin deposit should have a crystal orientation that matches that of the nickel deposit.

The mixed acid/non-MSA chemistry combined with specific additives consistently produces a preferred crystal orientation which is identical to that of the underlying substrate in all cases. It is believed that this phenomenon reduces stress in the deposit and therefore eliminates a major driving force for tin whisker growth. Of course, one of ordinary skill in the art, having this disclosure before them, can conduct routine testing to determine the preferred solution chemistries and specific additives that will provide the preferred crystal orientations of the deposit during electroplating to avoid the tin whiskering problem.

What is claimed is:

1. A method for reducing tin whisker formation in a tin deposit, which comprises electroplating the tin deposit directly on an underlying metal comprising copper or a copper alloy, wherein the deposit is predominantly in a predetermined crystal orientation, measurable by X-ray diffraction, that essentially matches that of the underlying metal in order to inhibit tin whisker growth in the tin deposit.

2. The method of claim 1, wherein the underlying metal forms a portion of a substrate of an electrical component and the crystal orientation of the deposit is <220>.

3. The method of claim 1, wherein the deposit contains at least 95% tin and optionally at least one alloying element of silver, bismuth, copper or zinc in an amount of 5% or less.

4. The method of claim 1, wherein the underlying metal is a deposit upon a substrate and the tin deposit has the same crystal orientation as that of the underlying metal deposit.

5. The method of claim 1, wherein the tin deposit is provided during electroplating from a solution comprising an acid, a tin salt, and a crystal orienting surfactant.

6. The method of claim 5, wherein the acid is a sulfonic acid, sulfuric acid, a halide ion acid, a fluoborate or mixtures thereof.

7. The method of claim 5, wherein the solution includes an alkylol sulfonic acid or solution soluble salt thereof in an amount sufficient to improve deposit appearance.

8. The method of claim 5, wherein the crystal orienting surfactant comprises a solution soluble organic compound having 2 to 4 joined rings, a total of 6 to 24 ring members, and at least one oxygen or nitrogen atom present in or attached to at least one of the rings.

9. The method of claim 5, wherein the crystal orienting surfactant comprises a solution soluble organic compound having 2 to 3 fused rings, a total of 6 to 14 ring members, and at least one nitrogen atom present in each of at least two rings.

10. The method of claim 5, wherein the crystal orienting surfactant comprises a block copolymer or a solution soluble organic compound that is a condensation compound of an alkylene oxide.

11. The method of claim 5, wherein the crystal orienting surfactant is a biquinoline, a dialkyl phenanthroline, a block copolymer, or an ethoxylated naphthol.

12. The method of claim 5, wherein the acid comprises a mixture of 2-hydroxy ethyl sulfonic acid or a salt thereof with sulfuric acid or an alkylsulfonic acid.

13. The method of claim 1, wherein the predetermined crystal orientation of the tin deposit is determined by X-ray diffraction to confirm that it essentially matches that of the underlying metal.

14. An electroplating solution comprising an acid, a tin salt, a crystal orienting surfactant in an amount sufficient to assist in providing a tin deposit directly on an underlying metal such that the deposit is predominantly in a predetermined crystal orientation, measurable by X-ray diffraction, that essentially matches that of the underlying metal in order to inhibit tin whisker growth in the tin deposit, and, optionally, a solution soluble salt of at least one alloying element, wherein the crystal orienting surfactant comprises a solution soluble organic compound having 2 to 4 joined rings, a total of 6 to 24 ring members, and at least one oxygen or nitrogen atom present in or attached to at least one of the rings.

15. The solution of claim 14, wherein the crystal orienting surfactant is a biquinoline, a dialkyl phenanthroline, a block copolymer, or an ethoxylated naphthol.

16. The solution of claim 14, wherein the acid is a sulfonic acid, sulfuric acid, a halide ion acid, a fluoborate or mixtures thereof, optionally including an alkylol sulfonic acid or solution soluble salt thereof in an amount sufficient to improve deposit appearance.

17. An electroplating solution comprising an acid, a tin salt, a crystal orienting surfactant in an amount sufficient to assist in providing a tin deposit directly on an underlying metal such that the deposit is predominantly in a predetermined crystal orientation, measurable by X-ray diffraction, that essentially matches that of the underlying metal in order to inhibit tin whisker growth in the tin deposit, and, optionally, a solution soluble salt of at least one alloying element, wherein the crystal orienting surfactant comprises a solution soluble organic compound having 2 to 3 fused rings, a total of 6 to 14 ring members, and at least one nitrogen atom present in each of at least two rings.

18. The solution of claim 17, wherein the acid is a sulfonic acid, sulfuric acid, a halide ion acid, a fluoborate or mixtures thereof, optionally including an alkylol sulfonic acid or solution soluble salt thereof in an amount sufficient to improve deposit appearance.

19. A method for reducing tin whisker formation in an electroplated tin deposit, which comprises electroplating the tin deposit onto the underlying metal from an electroplating solution comprising an acid, a tin salt, a crystal orienting surfactant in an amount sufficient to assist in providing a tin deposit directly on an underlying metal such that the deposit is predominantly in a predetermined crystal orientation, measurable by X-ray diffraction, that essentially matches that of the underlying metal in order to inhibit tin whisker growth in the tin deposit, and, optionally, a solution soluble salt of at least one alloying element, wherein the predetermined crystal orientation of the tin deposit is determined by X-ray diffraction to confirm that it essentially matches that of the underlying metal, so that the tin deposit is predominantly provided in the predetermined crystal orientation, thus reducing tin whisker formation in the deposit.

20. The method of claim 19, wherein the underlying metal is a deposit upon a substrate and the tin deposit has the same crystal orientation as that of the underlying metal deposit.

21. The method of claim 19, wherein the tin deposit is provided during electroplating from a solution comprising an acid, a tin salt, and a crystal orienting surfactant.

22. The method of claim 19, wherein the acid is a sulfonic acid, sulfuric acid, a halide ion acid, a fluoborate or mixtures thereof.

23. The method of claim 19, wherein the solution includes an alkylol sulfonic acid or solution soluble salt thereof in an amount sufficient to improve deposit appearance.

24. The method of claim 19, wherein the crystal orienting surfactant is a biquinoline, a dialkyl phenanthroline, a block copolymer, or an ethoxylated naphthol.

25. A method of reducing environmental contamination resulting from electroplated parts with underlying metal portions comprising copper or a copper alloy, which method comprises directly electroplating the underlying metal portions of the parts with tin or a tin alloy containing at least 95% tin such that the deposit is predominantly in a predetermined crystal orientation, measurable by X-ray diffraction, that essentially matches that of the underlying metal in order to inhibit tin whisker growth in the tin deposit, thus avoiding the need to plate the parts with a tin alloy that contains an environmentally harmful alloying element.

26. The method of claim 25, wherein the predetermined crystal orientation of the tin deposit is determined by X-ray diffraction to confirm that it essentially matches that of the underlying metal.

27. The method of claim 25, wherein the tin deposit is provided during electroplating from a solution comprising an acid, a tin salt, and a crystal orienting surfactant.

28. The method of claim 25, wherein the acid is a sulfonic acid, sulfuric acid, a halide ion acid, a fluoborate or mixtures thereof.

29. The method of claim 25, wherein the solution includes an alkylol sulfonic acid or solution soluble salt thereof in an amount sufficient to improve deposit appearance.

30. The method of claim 25, wherein the crystal orienting surfactant is a biquinoline, a dialkyl phenanthroline, a block copolymer, or an ethoxylated naphthol.

* * * * *